United States Patent [19]

Nakada et al.

[11] 4,240,264

[45] Dec. 23, 1980

[54] INTERIOR UNIT OF A SPLIT TYPE AIR-CONDITIONING APPARATUS

[75] Inventors: Minoru Nakada; Kenji Umezu, both of Fuji; Yasuhiro Shinma, Shimada; Kazuaki Kamiyama, Fujinomiya; Yoshihiro Udagawa; Masaya Yamazaki, both of Fuji; Mitsuo Murano, Fujinomiya; Minoru Inoue, Shimizu, all of Japan

[73] Assignee: Tokyo Shibaura Denki Kabushiki Kaisha, Kanagawa, Japan

[21] Appl. No.: 965,044

[22] Filed: Nov. 30, 1978

[30] Foreign Application Priority Data

Nov. 30, 1977 [JP] Japan ..... 52/160788[U]

[51] Int. Cl.[3] ..... F04B 17/00; F24H 3/06

[52] U.S. Cl. ..... 62/125; 62/262; 98/94 AC; 165/122; 417/423 R

[58] Field of Search ..... 62/262, 125; 98/94 AC; 165/122; 417/423

[56] References Cited

U.S. PATENT DOCUMENTS

| | | | |
|---|---|---|---|
| 3,303,325 | 2/1967 | Hubrich | 165/122 X |
| 3,401,871 | 9/1968 | Crowe . | |
| 3,795,274 | 3/1974 | Fieni | 165/122 |
| 3,839,880 | 10/1974 | Premaza | 165/122 X |
| 4,002,109 | 1/1977 | Hori et al. | 98/94 AC |

FOREIGN PATENT DOCUMENTS

| | | |
|---|---|---|
| 47-24225 | 7/1972 | Japan . |
| 50-74505 | 6/1975 | Japan . |
| 51-69369 | 6/1976 | Japan . |

*Primary Examiner*—William E. Wayner

*Attorney, Agent, or Firm*—Oblon, Fisher, Spivak, McClelland & Maier

[57] ABSTRACT

An interior unit of a split type air-conditioning apparatus which is usually mounted on a wall of a room to be cooled and is extremely thin. The unit consists of a cabinet structure including a front panel, a middle frame and a rear plate, said front panel having an air inlet opening and an air outlet opening. Also included is a centrifugal fan, preferably a turbo fan with a plurality of backward curved blades, specially designed to adapt to the unit. The means for driving said fan are designed to be partly accommodated in the body of the turbo fan for the purpose of decreasing the depth of the unit.

31 Claims, 30 Drawing Figures

INTERIOR UNIT OF A SPLIT TYPE AIR-CONDITIONING APPARATUS

BACKGROUND OF THE INVENTION

1. Field of the Invention

This invention relates to an air-conditioning apparatus, but is more particularly concerned with improvements in an interior unit of a split type air-conditioning apparatus which is installed in a room to be cooled.

2. Description of the Prior Art

Heretofore various types of split type air-conditioning apparatus have been presented. It has been recognized that such a split type air-conditioning apparatus largely consists of an interior unit and an exterior unit.

The interior unit is designed to accommodate an interior heat exchanger normally used as an evaporator and a cross flow fan disposed at the rear of the interior heat exchanger for circulating air in the room to be cooled.

The exterior unit is mounted outside the house and contains an exterior heat exchanger, a fan and a compressor, etc. to cooperate with the interior unit to provide a complete refrigeration cycle.

The interior unit and the exterior unit are combined by the conduits through which refrigerant flows from one unit to the other for a thermal exchange which takes place at both units.

In all these prior devices, however, the interior unit bulk is large due particularly to the combination of the interior heat exchanger and the cross flow fan being disposed with one in front of the other. When installed on a wall or the like the unit gives the user a sense of oppression and uneasiness as it protrudes from the wall by almost a foot.

In an attempt to represent the prior state of the art a conventional interior unit of the split type air-conditioner is shown in FIGS. 1 and 2.

The interior unit, as shown in FIG. 1, includes at its bottom the bottom plate a, on which vertically rises supporting wall c. The supporting wall c forms a fan shroud b and supports a cross flow fan d driven by the fan motor e.

In front of the supporting wall c is fixed the table plate f which extends horizontally frontward and upon which is placed a drain pan g. The drain pan g accommodates an interior heat exchanger h.

The whole unit is covered by a cabinet member i and a front panel j.

For installing the unit an installation plate l in FIG. 2 is first fixed to an interior wall k and then the unit is hung on the installation plate l.

The unit just described requires an objectionably large depth.

SUMMARY OF THE INVENTION

It is therefore a primary object of the invention to provide an improved, compact, thin and light weight interior unit of a split type air-conditioning apparatus which can be installed on the wall of the room.

It is another object of the invention to provide an interior unit of a split type air-conditioning apparatus which does not give the user a sense of oppression and uneasiness when installed on the wall of the space to be cooled.

A further object of the invention is to provide an interior unit of a split type air-conditioning apparatus which consists of three major components, namely:

front panel, middle frame and rear plate, all of which can be easily fashioned.

Another object of the invention is to provide an interior unit of a split type air-conditioning apparatus comprising a thin-type, single row heat exchanger which will not superheat and with high performance.

Still a further object of the invention is to provide an interior unit of a split type air-conditioning apparatus which comprises a pair of thin-type turbo fans with a plurality of backward curved blades.

BRIEF DESCRIPTION OF THE DRAWINGS

Other objects and many of the attendant advantages of this invention will be readily appreciated by reference to the following detailed description when considered in connection with the accompanying drawings in which.

DETAILED DESCRIPTION OF THE PREFERRED EMBODIMENTS

In the particular embodiment of the present invention depicted in the accompanying drawings, it will be noted that an interior unit of a split type air-conditioning apparatus has been selected to illustrate a preferred application of the invention.

Figure 1:
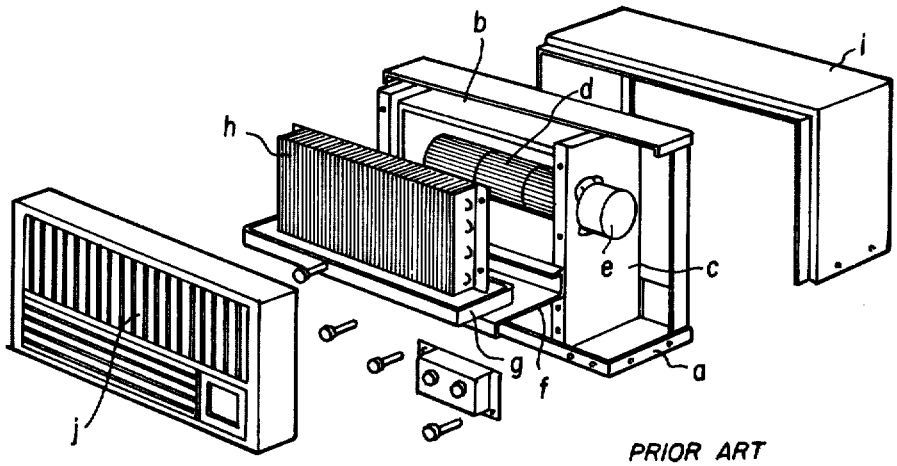
FIG. 1 is an exploded perspective of the interior unit representative of prior art.
Figure 2:
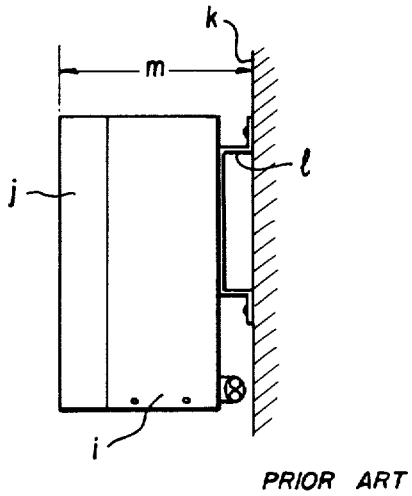
FIG. 2 is a side elevation of the unit in FIG. 1 installed on the wall.
Figure 3:
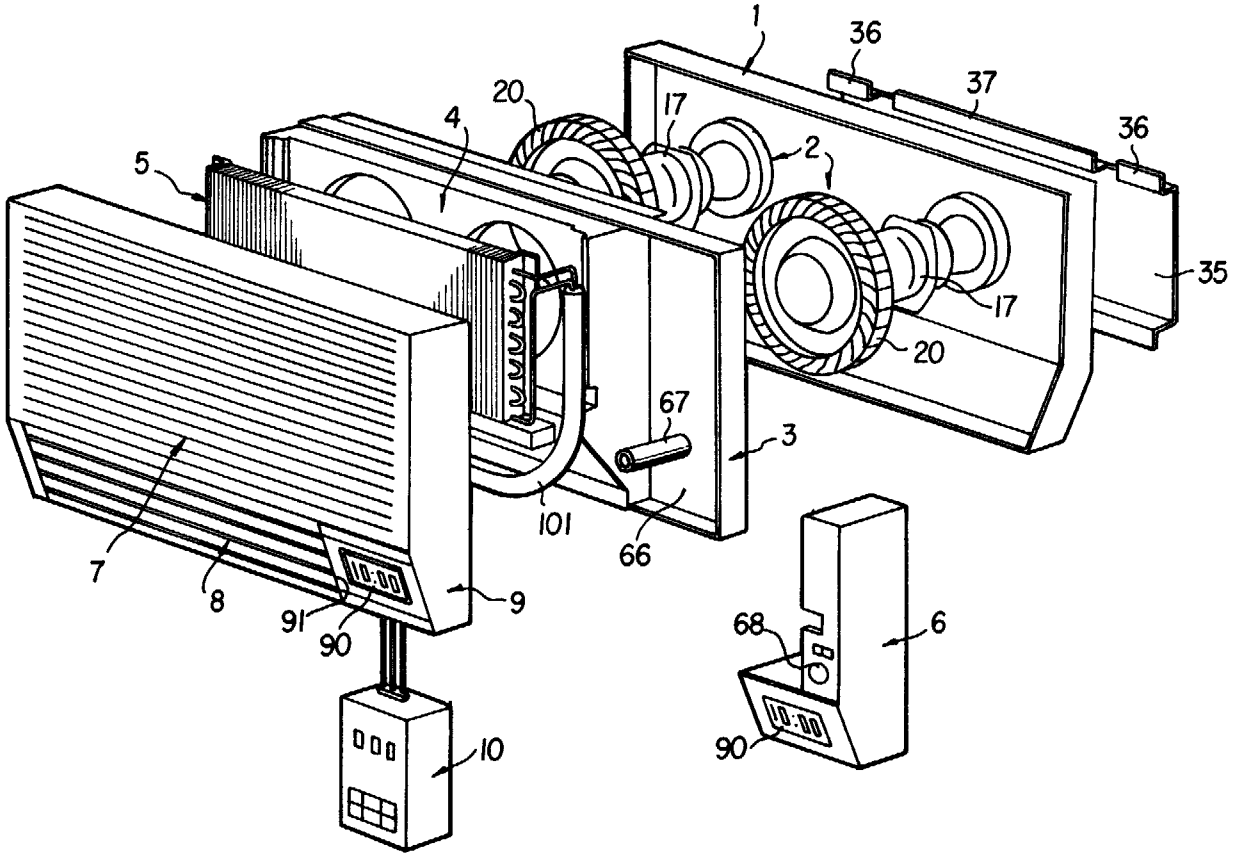
FIG. 3 is an exploded perspective of the proposed unit.

The proposed interior unit presented in FIG. 3 includes a rear plate 1 to which are fixed centrifugal fans, or more specifically turbo fans 2, and fan motors 17, and which is fashioned with the middle frame 3. The rear plate 1 and the middle frame 3, when fashioned, provide a fan shroud 4 for housing the turbo fans 2.

The middle frame 3 is also fashioned with a front panel 9 which comprises an air inlet opening 7 formed on the upper half, and air outlet opening 8, both of which are circulating air therethrough.

In the bottom-right corner of the front panel 9 is provided a digital display panel 90 designed for displaying time and the like to suit a user's convenience.

Placed between the front panel 9 and the middle frame 3 is an electric equipment cell 6 to house electric components including those for the digital display panel 90.

Almost all the electric accessories are concentrated together and contained in the electric equipment cell 6 so that maintenance operations and electrical check-ups which should be conducted periodically can be to a large extent facilitated.

The numeral 3 indicates the middle frame, which includes a slide rod 67, formed integrally therewith, while the electrical equipment cell 6 is provided with a horizontally extending tunnel 68 for slidably accepting the slide rod 67. It should be noted that while they are in a rotational relationship, an unstable condition of the electrical equipment cell 6 can be necessarily avoided both by means of decreasing the tolerance therebetween and by means of providing stopper means for the middle frame 3 which may prevent rotational movement of the electrical equipment cell 6.

Around the slide rod 67 is formed a recessed portion 66 for accommodating the electrical equipment cell 6.

A heat exchanger 5 is postioned to the middle frame 3 and faces the air inlet opening 7 so that the air stream which flows inwardly may directly touch the fins of the heat exchanger 5 for a thermal exchange between the air and the refrigerant, whereby the air may lose its enthalpy as the temperature is lowered to a certain level.

It will be easily understood by those skilled in the art that the present refrigerant conduit 101 connects the interior unit and the exterior unit, not described in the specification, and is designed to circulate refrigerant from one unit to the other continuously.

The rear plate 1 also mounts a couple of fan motors 17 which are to drive the turbo fans 2 comprising a plurality of backward curved blades 20.

FIG. 3 also shows an installation plate 35 with which the unit can be installed on the wall and having turned up flange portions 36 and 37 to reinforce itself. The flange portion or hook element 36 also functions as a means to hang the unit.

Figure 4:
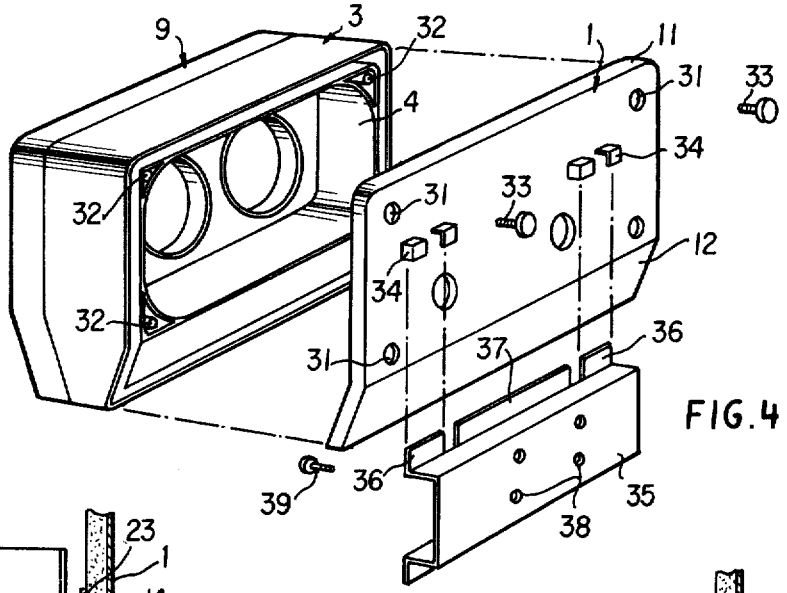
FIG. 4 is an exploded perspective of the cabinet structure of the unit in FIG. 3.

Now going into a more detailed explanation of each part of the proposed interior unit, in FIG. 4 is shown the cabinet structure, where the front panel 9 is already closely fashioned with the middle frame 3.

In all the four corners at the back of the middle frame 3 there are formed four holes 32 for accepting bolts or screws 33. The four holes are part of the surrounding flange member.

The rear plate 1 has all along its margin the flanged portion 11, and, in all four corners, small holes 31 are dug in the corresponding position of the holes 32 to receive bolts or screws 33 which may be applied over the rear plate 1.

At the back of the rear plate 1 two pair of curled pieces 34, are erected, which preferably are integrally formed at the time of the press working process.

The installation plate 35 is angled and extends from one side onto the other, discontinued in part so as to form both hooks 36 and reinforced element 37. While the hooks 36 are inserted into the curled pieces 34, the installation plate 35 itself is secured to the wall by means of screws or bolts 39 making use of a plurality of holes 38 provided in the plate.

Figure 5:
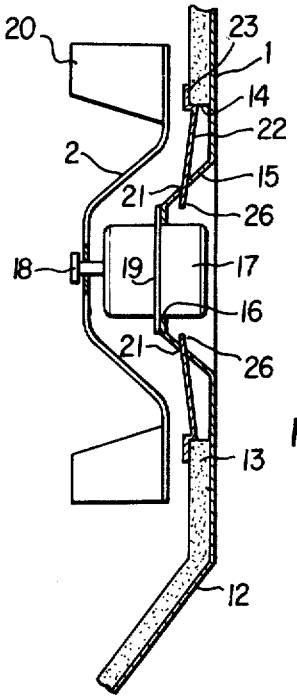
FIG. 5 is a vertical sectional view of the centrifugal fan of the unit in FIG. 3.
Figure 6:
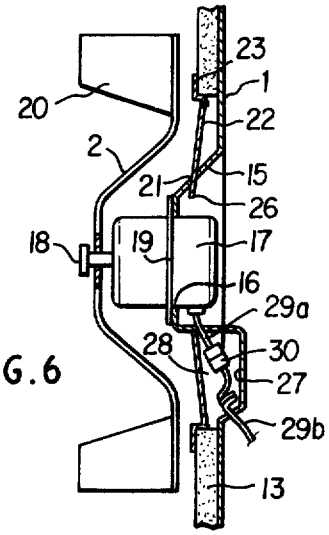
FIG. 6 is a vertical sectional view of the centrifugal fan and insulation holding element positioned to the rear plate of the unit in FIG. 3.
Figure 7:
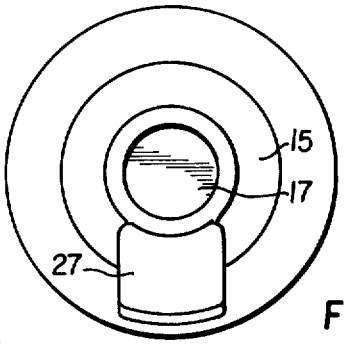
FIG. 7 is an elevational view of the circular raised portion of the rear plate of the proposed unit in FIG. 3.

Referring now to FIGS. 5 to 7, the turbo fan system comprises a fan motor 17 and a turbo fan 2 with a plurality of backward curved blades. The rear plate 1 is provided with a raised circular mount 15, and the inside surface of the rear plate 1 is for the most part covered with a thermal insulating material 13, such as soft polyethylene foam and soft polyurethane foam, pasted down to the sloping surface 12, with the exception of the vicinity of the raised circular mount 15.

On the top table of the raised circular mount 15 a round aperture 16 is presented, to which the bottom of the fan motor 17 is placed. The flange 19 attached around the barrel contacts the summit portion of the aperture 16 where bolts or screws are applied to combine them rigidly.

The flange 19 may be desirably attached around the barrel of the fan motor near the center of gravity, when the turbo fan 2 is fixed, with a view to avoiding apprehended vibrations and noise which would give much harassment to the users.

The motor shaft 18 projecting from the fan motor 18 can be equipped with the turbo fan 2 which has a plurality of backward curved blades 20 to impel the air with higher efficiency but with less noise.

In view of the state of the art with which the skilled person is familiar, the use of a centrifugal fan in an interior unit of a split type air-conditioner may be said to be novel and an innovation, due to the technical difficulties which have been a major hindrance to the development of a new and useful apparatus.

The proposed invention successfully removes the engineering obstacles and develops a unique fan system utilizing a turbo fan with backward curved blades which lends itself not only to lessen the dimension but to decrease the weight of the unit. The presented turbo fan produces less noise as well.

The rear plate 1 also has a recess 27 shown in FIG. 6 at the foot of the raised circular mount 15 aimed at accommodating the connector element 30 connecting the electric cord 29 a from the fan motor 17 and the electric cord 29*b* from the power source. The recess 27 is formed integrally with the rear plate 1 and has holes in the middle of the upper part and the bottom part through which the electric cords 29*a* and 29*b* pass.

The bulge of the raised circular mount 15 further comprises an insulation holding element 22 which is formed of a resilient steel plate.

Figure 8:
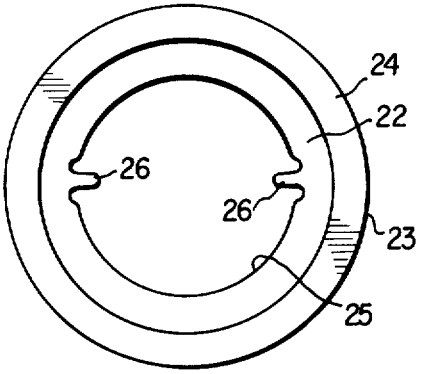
FIG. 8 is a plan view of the insulation holding element in FIG. 5 and FIG. 6.
Figure 9:
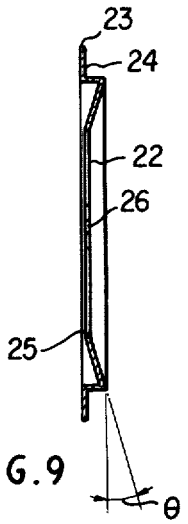
FIG. 9 is a sectional view of the insulation holding element in FIG. 8 in its normal position.
Figure 10:
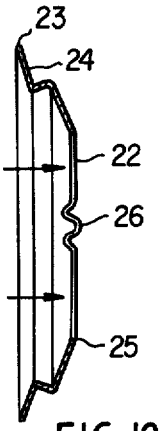
FIG. 10 is also a sectional view of the insulation holding element in FIG. 8 in its open position.

The insulation holding element 22, when positioned, functions as a cover to the recess 27 and conceals the connector element 30 and as part of its function, frames the space for it. The insulation holding element 22, details of which are shown in FIG. 8, can take two positions, namely the normal position of FIG. 9 and the open position of FIG. 10.

Given a fingerpush, the element shifts from the normal position to the open position, but it tends to return to the normal position as soon as the external force disappears.

The insulation holding element 22 turns from one position to the other by a spring action due to its own resiliency.

The insulation holding element 22 has a brim portion 24 which is flat in its normal position and is slanted in its open position.

The inner annular flange 25 is provided with a catch means 26 to engage an aperture 21 of the raised circular mount 15.

With reference to the manner of securement of the insulation holding element 22 to the upheaved circular mount 15, the element is first pushed to convert it to the open position, then the catch means 26 is put into the aperture 21 and the element then released. The element then is inclined to return to the normal position with its flange 23 applying reasonable stress on the periphery of the thermal insulation material 13 so that the material will never be likely to touch or contact the turbo fan 2 and disturb its revolving movement.

Figure 11:
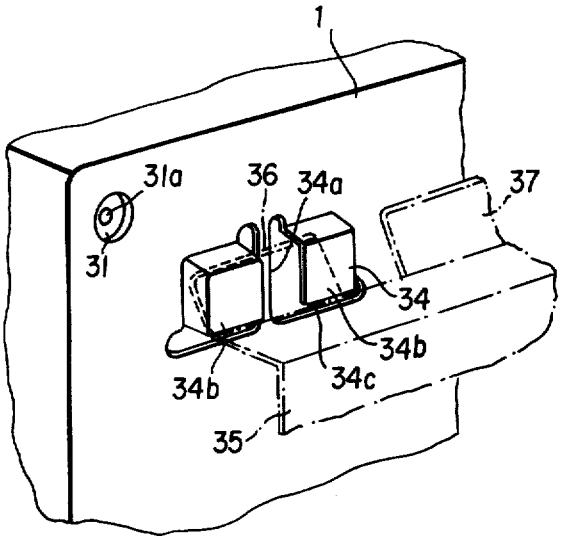
FIG. 11 is a partial perspective of the rear plate of the proposed unit shown in FIG. 4.

A novel feature of the present invention is shown more clearly in FIG. 11 in which the hook element 34 is presented. The hook element 34 preferably consists of a pair of symmetric curled shelters 35*b*, which have openings 34*c* to admit the hook 36 of the installation plate 35. The curled shelters 34*b* are spaced by a bridge member 34 a with a certain open distance between them.

The small hole 31 may be dug to a certain depth and there is an aperture 31 a at its bottom designed to pass through a bolt shank.

A plurality of hook elements 34 are provided at the back of the rear plate 1 and can be easily engaged with the hooks 36 of the installation plate 35 to rigidly support the whole weight of the interior unit.

Figure 12:
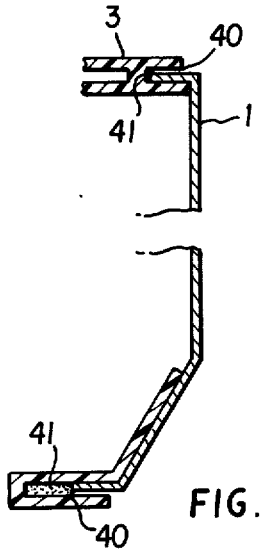
FIG. 12 is a longitudinally sectional view of the joint portion of the middle frame and the rear plate of the unit in FIG. 4.
Figure 13:
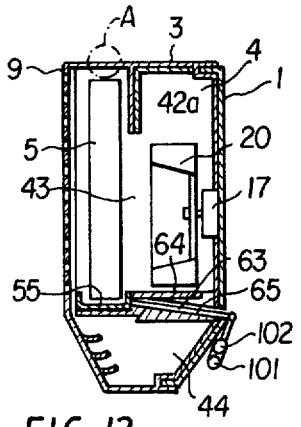
FIG. 13 is a longitudinally sectional view of the proposed unit in FIG. 3.
Figure 14:
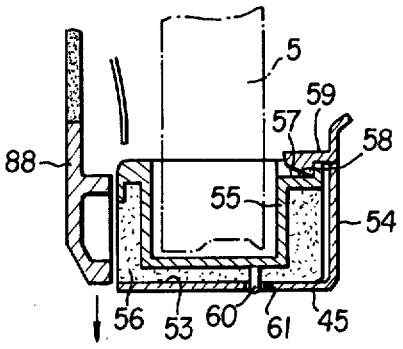
FIG. 14 is an enlarged sectional view of the drain pan and the drain pan holder of the middle frame of the proposed unit in FIG. 13.
Figure 15:
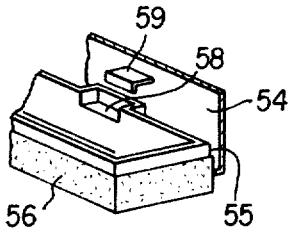
FIG. 15 is a partial perspective of the catch member of the middle frame of the proposed unit in FIG. 13.
Figure 16:
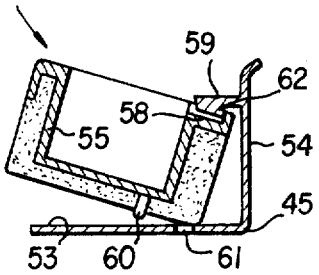
FIG. 16 also shows a sectional view of the drain pan and the drain pan holder of the middle frame of the proposed unit in FIG. 13.

FIG. 12 shows the combination of the edges of the rear plate 1 and the middle frame 3. The middle frame 3 has a bifurcated flange member 40 forming a channel or groove to receive the marginal flange 11 of the rear plate 1. For the purpose of preventing thermal transfer, the bifurcated flange channel is filled with thermal insulation material 41, such as foamed plastic resin, having slight elasticity so that it can absorb manufacturing errors necessarily accompanying each component.

FIGS. 13 to 16 show the drainage disposal system. The air gets dehydrated when it passes through the heat exchanger 5, while the drainage produced at the heat exchanger 5 drops down to the drain pan 55 disposed at the bottom of the heat exchanger 5 where it is stored and then is transferred outdoors via the drain hose 102, which is bundled with the refrigerant conduit 101. The dehydrated air next flows to the air outlet hall 44 and is forced out of the unit.

The middle frame 3 has a vertical portion 54 and also has an extended horizontal portion 53 both of which cooperate together to form the drain pan holder 45 on which the drain pan 55 is placed. The drain pan 55 is integrally formed of synthetic plastic resin and is covered externally by the thermal insulating material 56. The drain pan 55 is provided with a projection 60 to engage the hole 61 of the drain pan holder 45 so that it can be firmly fixed in place.

The vertical portion 54 has a catch member 59 which is integrally formed with the middle frame and having elasticity of flexure, while in the corresponding position of the drain pan 55 is provided a trap 58. They can effectively engage to press and hold downward the drain pan 55.

The drainage pan 55 can slide into the predetermined position first by latching the catch member 59 to the trap 58 and next by inserting the projection 50 into the hole 61.

Figure 17:
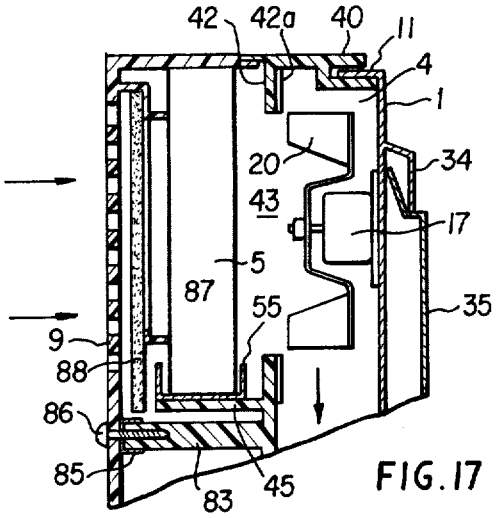
FIG. 17 is a longitudinally sectional view of the upper half of the proposed unit in FIG. 13.
Figure 24:
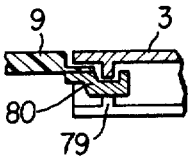
FIG. 24 shows a joint portion of the front panel and the middle frame in FIG. 3.

FIG. 17 shows the combination of the middle frame 3 and the front panel 9. The internal surface of the middle frame 3 is thermally insulated by the insulation material 42*a*. The upper junction of the middle frame 3 and the front panel 9 is detailed in FIG. 24, where the front panel 9 has a claw member 80 at its marginal edge which can interlock the marginal trap 79 of the middle frame 3.

Figure 25:
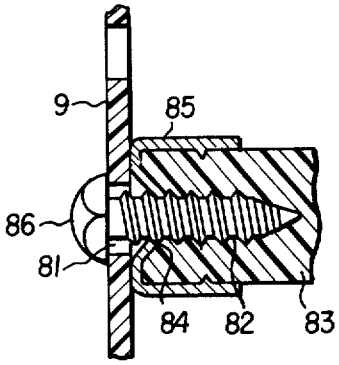
FIG. 25 shows an enlarged sectional view of the cap element in FIG. 17.

In FIG. 25 the several screws 86 are shown which link front panel 9 and middle frame 3. As shown in FIG. 25 the horizontally extending rack 83 of the middle frame 3 is placed about the front panel 9, and where the rack 83 contacts the front panel the cap member 85 may be positioned.

The cap member 85 is so secured as to protect the top from any crack which might otherwise be generated by the screw 86.

The holes 81, 84, and 82 are dug in the respective members into which is inserted the screw 86 for combining the two major components.

Figure 26:
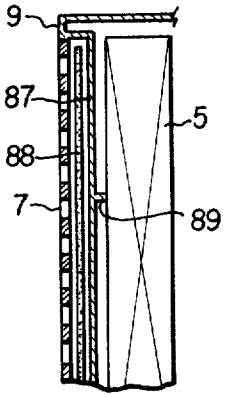
FIG. 26 shows a longitudinal sectional view of the combination of the front panel, the filter element and the heat exchanger.

On the drain pan 55 is placed the heat exchanger 5 which is spaced by the spacer means 89 integrally formed with the front panel 9 as in FIG. 26. In front of the heat exchanger 5 and just at the rear of the front panel 9 there is an air filter 88, which excludes dusts and the like in an attempt to clean the air in circulation.

Figure 18:
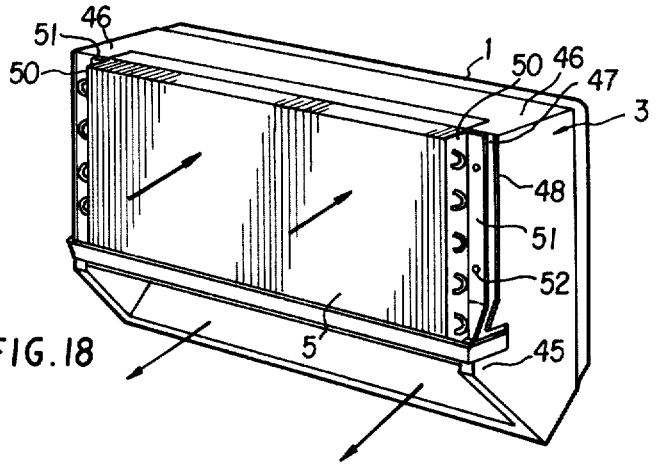
FIG. 18 is an perspective of the interior heat exchanger and the rear plate of the unit in FIG. 3.
Figure 19:
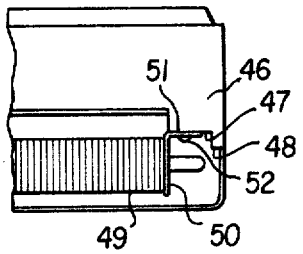
FIG. 19 is a partial cross sectional view of the proposed unit in FIG. 13.

Referring to the heat exchanger 5 with reference to the FIGS. 18 and 19, the refrigerant conduit is bent in serpentine form to provide a plurality of horizontal passages. The heat exchanger 5 is a single-row type heat exchanger so that it can decrease the dimension of the unit.

The end plates 50, 50 at both ends of the heat exchanger 5 are attached to the marginal edge 47 of the frame base 46 by several screws 52. Also formed integrally with the frame base 46 is a vertically extending ridge 48. At the bottom of the ridge 48 is formed the drain pan holder 45 for supporting the drain pan 55.

Figure 20:
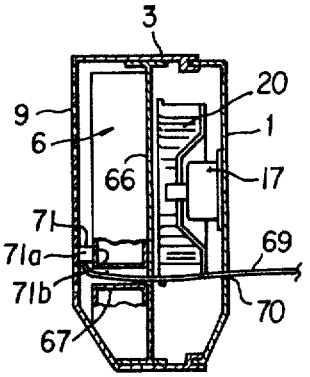
FIG. 20 is a longitudinally sectional view of the proposed unit in FIG. 3.

As shown in FIG. 20, at the side of the heat exchanger 5 and faced by the front panel 9 there is provided an electric equipment cell 6 which contains the electrical element necessary for air conditioning operation of the entire apparatus.

Figure 21:
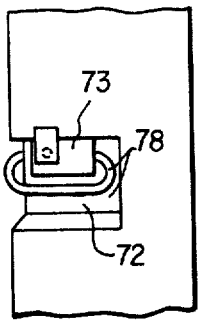
FIG. 21 shows a schematic view of the thermal sensing element attached to the electric equipment cell shown in FIG. 3.
Figure 22:
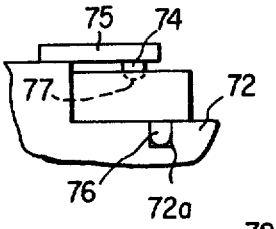
FIG. 22 also shows an enlarged cross sectional view of the thermal sensing element shown in FIG. 21.
Figure 23:
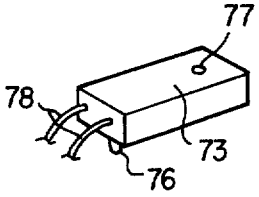
FIG. 23 shows a general perspective of the thermal sensing element in FIG. 21 and FIG. 22.

In front of the electric equipment cell 6 is applied a connector 71. The electric cord 69 from the outside is connected to the terminal 71*a*, which joins the female terminal 71*b* positioned to the front side of the electric equipment cell 6. The electric cord 69 threads through the slide rod 67. FIGS. 21 to 23 illustrate the thermal sensing element.

The electric equipment cell 6 has a recessed portion 72 on the front side where it can accommodate the thermal sensing element 73 which is connected to the other elements in the special manner by the lead wires 78.

The thermal sensing element 73 in a hexahedronal shape possesses a projection 76 on the one side and a small hole 77 on the other side.

With respect to the manner of coupling the thermal sensing element 73 to the electric equipment cell 6. First the projection 76 is applied to the small hole 72*a* formed at the bottom of the recessed portion 72, then the projection 76 is applied onto the small hole 77 interlocking the projection 74 formed on the resilient plate 75, which is attached to the front side of the elastic equipment cell 6. The resilient plate 75 can be formed of steel plate, but is more preferably made of synthetic plastic resin which possesses resiliency adequate to function as a plate spring for giving reasonable pressure to the element 73.

The lead wire 78 of the thermal sensing element 73 should measure less than 0.3 mm across and the exposed length of it between the electric cell 6 and the thermal sensing element 73 should measure more than 5 cm for the purpose of checking the undesirable effects attributed to the heat which might be generated inside the electric equipment cell 6.

Consequently thermal sensing element 73 can function independently of the thermal effect of the heat being transferred to the wire may be discharged at the exposed part.

Figure 27:
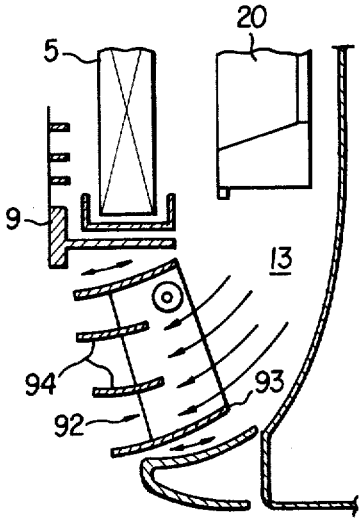
FIG. 27 is a partly enlarged longitudinal sectional view of the front grille of the proposed unit in FIG. 3.

Moving onto the FIG. 27 in which an enlarged partial vertical sectional view of the air outlet control structure 92 is shown, and by means of which an air stream after being regulated may be discharged to any desired direction. The air outlet control structure 92 is made from plastic resin in an attempt to lend itself not only to light weight of the unit but to prevent the moisture in the atmosphere from condensing on the plurality of blades 94.

The blades 94 are spaced from each other by the optimum distance, and are curved or have the edge turned a bit upward so as to discharge the air stream smoothly and with least resistance from the unit.

Figure 28:
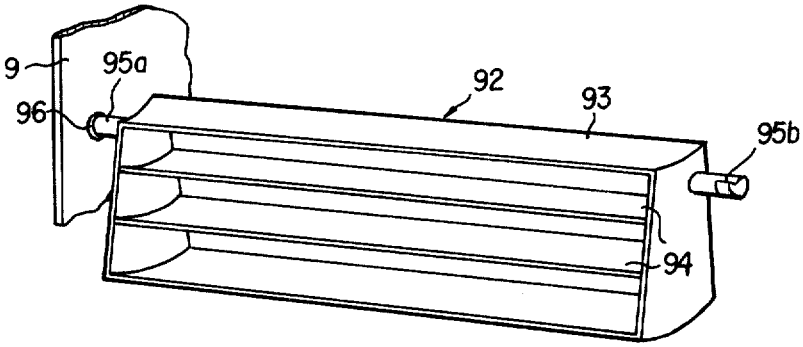
FIG. 28 shows a general perspective of the front grille and the pivot member in FIG. 27.

The numeral 93 indicates the air grille, the one side pivotably supported by the pivot member 95 a which is attached near the upper ends of the grille and is inserted into the bearing or the hole 96 of the front panel 9 as shown in FIG. 28. The pivot member 95*a* needs to be secured almost to the top end of the air grille 93 because otherwise the uppermost blade might interfere with the normal air flow when the grille moves upward.

Figure 29:
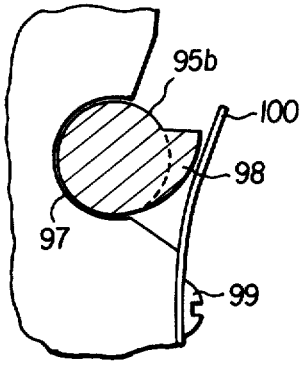
FIG. 29 shows a cross sectional view of the front grille in FIG. 28.

The enlarged sectional view of the end of the other pivot member 95*b* is clearly shown in FIG. 29 in which the pivot member 95*b* is held both by the concave portion 97 of the front panel 9 and the spring plate 100 which is secured to the front panel 9 by means of a screw 99.

The pivot member 95*b* functions as a cam as it is formed so that it possesses a radius-expanding section which is in frictional contact with the spring plate 100.

As a result, the air grille 93 can be held at any desired position aimed at sending the air stream to the direction which the user hopes for.

Figure 30:
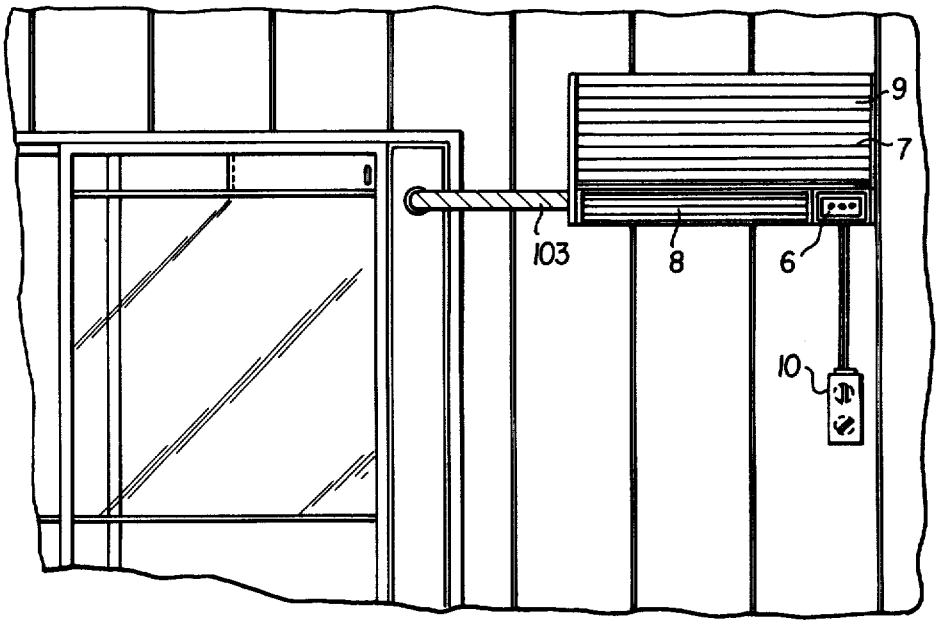
FIG. 30 shows a general view of the proposed unit installed and on the wall near the window of the room to be air-conditioned.

FIG. 30 shows the general exterior outlook of the interior unit of the present invention installed on the room wall.

Cover tape 103 is used to bundle the drain hose 102 and the refrigerant conduit 101 together to present a better appearance. The cover tape 103 is preferably colored and patterned identically with the wall, for example, when the wall is grained, so is the color tape 103.

The unit is controlled with the remote control box 10 which is connected to the electric equipment cell 6 comprised inside the unit, and even when the unit is installed in a high place which is beyond a user's reach it can be controlled without difficulty.

Obviously many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An interior unit of a split type air-condition apparatus comprising:

a cabinet structure having an air inlet opening for introducing air and an air outlet opening for discharging air said cabinet structure including a rear plate for mounting said fan motor, a middle frame assembled to said rear plate, said middle frame fixing said heat exchanger and having a fan shroud for housing said centrifugal fan, a front panel assembled to said middle frame and having said air inlet opening and said outlet opening on its front side;

refrigeration cycle components arranged inside said cabinet structure including a heat exchanger;

means for circulating air including a centrifugal turbo fan with a plurality of backward curved blades disposed inside said cabinet structure, said centrifugal fan having a circular part raised in a longitudinal direction in the approximate center of said fan;

means for driving said centrifugal fan including a fan motor accommodated in said raised circular part and having a motor shaft extending in said longitudinal direction, said fan being fixed to said motor shaft at the center thereof wherein said rear plate includes a circular mount raised in said longitudinal direction, said mount supporting said fan motor about the approximate center of gravity of said fan motor along a line extending in said longitudinal direction, whereby the thickness of said apparatus in said longitudinal direction and the vibration of said motor are minimized.

2. An interior unit of a split type air-conditioning apparatus as set forth in claim 1 characterized in that said unit comprises a plurality of turbo fans.

3. An interior unit of a split type air-conditioning apparatus as set forth in claim 2 characterized in that said unit comprises a pair of said turbo fans.

4. An interior unit of a split type air-conditioning apparatus as set forth in claim 3 characterized in that said pair of turbo fans rotate in the same direction.

5. An interior unit of a split type air-conditioning apparatus as set forth in claim 1 characterized in that said rear plate comprises a thermal insulating material applied to an interior portion thereof, and a member for holding said insulation material, said member being interlocked to said raised circular mount for preventing said thermal insulation material from interfering with the movement of said blades of said turbo fan.

6. An interior unit of a split type air-conditioning apparatus as set forth in claim 5 characterized in that said insulation holding member is formed of an annular-shaped elastic metal plate comprising an inner portion and an outer portion, said inner portion coaxially and integrally formed with the outer portion and capable of being protruded by utilizing its own resiliency from said outer portion peripherally surrounding said inner portion.

7. An interior unit of a split type air-conditioning apparatus as set forth in claim 6 characterized in that said inner portion of said insulation holding member further comprises a pair of oppositely disposed coupling projections integrally formed therewith for interlocking said holding member to said raised circular mount of said rear plate.

8. An interior unit of a split type air-conditioning apparatus as set forth in claim 1 characterized in that said raised circular mount has a recess formed at its peripheral portion for housing electric accessories of said fan motor.

9. An interior unit of a split type air-conditioning apparatus as set forth in claim 8 characterized in that said rear plate has a plurality of hook elements on its outer side integrally formed therewith for hanging said unit.

10. An interior unit of a split type air-conditioning apparatus as set forth in claim 9 characterized in that said hook elements consist of a plurality of pairs of curled pieces which are erected during the press forming process of said rear plate.

11. An interior unit of a split type air-conditioning apparatus as set forth in claim 1 characterized in that said middle frame is formed of injection-molded synthetic resins.

12. An interior unit of a split type air-conditioning apparatus as set forth in claim 11 characterized in that said middle frame has a bifurcated member formed around a flange for receiving the edge portion of said rear plate.

13. An interior unit of a split type air-conditioning apparatus as set forth in claim 11 characterized in that said middle frame further comprises a drain pan placed at the bottom of said heat exchanger for receiving the drainage produced at said heat exchanger, and a drain pan holder integrally formed with and horizontally extended from said middle frame for placing and fixing said drain pan.

14. An interior unit of a split type air-conditioning apparatus as set forth in claim 13 characterized in that said middle frame comprises a catch member integrally formed therewith and disposed over said drain holder and pressing said drain pan downward for holding said drain pan in place between said catch member and said drain pan holder.

15. An interior unit of a split type air-conditioning apparatus as set forth in claim 14 characterized in that said drain pan holder has an aperture on its bottom part while said drain pan has a prominence thereunderneath in the position corresponding to said aperture for correctly and fixedly interlocking said drain pan to said drain pan holder.

16. An interior unit of a split type air-conditioning apparatus as set forth in claim 14 characterized in that said drain pan holder has a groove thereabove in the position corresponding to said catch member of said middle frame for fixedly positioning and receiving said catch member.

17. An interior unit of a split type air-conditioning apparatus as set forth in claim 1 characterized in that the unit further comprises an electric equipment cell in which to hold electric components of the unit.

18. An interior unit of a split type air-conditioning apparatus as set forth in claim 17 characterized in that said middle frame has a guide means integrally formed therewith and horizontally projected toward said front panel for slidably guiding and positioning said electric equipment cell in place.

19. An interior unit of a split type air-conditioning apparatus as set forth in claim 18 characterized in that said electric equipment cell is provided with a horizontally extending tunnel formed therewith for slidably accepting said guide means.

20. An interior unit of a split type air-conditioning apparatus as set forth in claim 17 characterized in that said electric equipment cell is formed of synthetic resin.

21. An interior unit of a split type air-conditioning apparatus as set forth in claim 20 characterized in that said electric equipment cell has a recess formed in its front side near said air inlet opening for attaching a thermal sensing element used to control the operation of the unit.

22. An interior unit of a split type air-conditioning apparatus as set forth in claim 21 characterized in that said thermal sensing element has a projection, and said recess of said electric equipment cell having a hole in the corresponding place for fixing and accepting said projection.

23. An interior unit of a split type air-conditioning apparatus as set forth in claim 22 characterized in that said thermal sensing element has a hole, said independent cell having a resilient plate with a projection to press and fix to said hole of said thermal sensing element.

24. An interior unit of a split type air-conditioning apparatus as set forth in claim 23 characterized in that said hole and said projection are formed on the opposite sides of said thermal sensing element.

25. An interior unit of a split type air-conditioning apparatus as set forth in claim 1 characterized in that said front panel further comprises a filter element for removing dust from air in circulation, a filter guide integrally formed therewith for supporting said guiding said filter element, and a spacer element horizontally projected and integrally formed with said filter guide to keep a required distance between said filter guide and said heat exchanger.

26. An interior unit of a split type air-conditioning apparatus as set forth in claim 1 characterized in that the unit further comprises a cap element applied to the top edge of said middle frame where said middle frame connects to said front panel for preventing the top edge from cracking.

27. An interior unit of a split type air-conditioning apparatus as set forth in claim 1 characterized in that said front panel comprises a front grille positioned at said air outlet opening, pivot members formed integrally therewith at both ends of said grille, and a pressing means attached near said pivot member to resiliently press and hold said pivot member at a desired angle.

28. An interior unit of a split type air-conditioning apparatus as set forth in claim 27 characterized in that said pivot member serves as a cam in relation to said pressing means.

29. An interior unit of a split type air-conditioning apparatus as set forth in claim 17 characterized in that said electric equipment cell has a display element.

30. An interior unit of a split type air-conditioning apparatus as set forth in claim 17 characterized in that the unit has a remote control box electrically connected to said electric equipment cell.

31. An interior unit of a split type air-conditioning apparatus as set forth in claim 1 characterized in that said heat exchanger is a one-column type heat exchanger in which a plurality of horizontal passes are arranged one on the other in a spaced relationship in one vertical plane.

* * * * *